United States Patent [19]

Nakayama et al.

[11] Patent Number: 5,057,155

[45] Date of Patent: Oct. 15, 1991

[54] MOLD FORMING MATERIAL

[75] Inventors: Susumu Nakayama; Shogo Ishizaki; Toru Iwaki, all of Osaka, Japan

[73] Assignee: Okazaki Minerals & Refining Co., Ltd., Osaka, Japan

[21] Appl. No.: 539,495

[22] Filed: Jun. 18, 1990

[30] Foreign Application Priority Data

Jun. 30, 1989 [JP] Japan ..... 1-170801

[51] Int. Cl.[5] ..... C09K 3/00; C04B 35/68

[52] U.S. Cl. ..... 106/35; 106/38.3; 106/38.22; 106/38.9; 106/38.2; 501/100; 501/102; 501/103; 501/108; 501/133

[58] Field of Search ..... 106/638, 35, 38.2, 38.3, 106/38.9, 38.22; 433/199.1, 200.1, 201.1, 213; 501/7, 100, 102, 103, 108, 133, 154

[56] References Cited

U.S. PATENT DOCUMENTS 3,649,732 3/1972 Brigham et al. ..... 106/35
4,661,071 4/1987 Bell et al. ..... 433/222.1
4,814,011 3/1989 Kamohara et al. ..... 106/35
4,909,847 3/1990 Ohi et al. ..... 106/35

FOREIGN PATENT DOCUMENTS 1-291856 11/1989 Japan ..... 433/199.1
0993942 2/1983 U.S.S.R. ..... 106/35

OTHER PUBLICATIONS

*Modern Ceramic Engineering,* Richerson, 1982, pp. 42–45.

*Primary Examiner*—William R. Dixon, Jr.
*Assistant Examiner*—Paul Marcantoni
*Attorney, Agent, or Firm*—Armstrong, Nikaido, Marmelstein, Kubovcik & Murray

[57] ABSTRACT

A mold forming material contains 1–20% by weight of spodumene. Spodumene is a lithium mineral whose theoretical composition formula is $Li_2O\ Al_2O_3\ 4SiO_2$. If casting is performed using a mold forming material containing spodumene, a casting which is satisfactory in appearance and accuracy is obtained.

2 Claims, No Drawings

MOLD FORMING MATERIAL

BACKGROUND OF THE INVENTION

This invention relates to a mold forming material used in casting operation and more particularly it relates to an investment material for forming molds to produce precision castings, such as dental castings.

For example, in dental casting, it has been common practice to use pure titanium or titanium alloys as casting materials. And as mold forming materials in this case it has been proposed to use, firstly, phosphate-bound investment materials whose components are quartz ($SiO_2$), cristobalite ($SiO_2$), phosphates and magnesia (MgO). Secondly, it has been proposed to use materials whose main components are thermodynamically relatively stable oxides such as alumina ($Al_2O_3$), zircon ($ZrSiO_4$), zirconia ($ZrO_2$), calcium oxide (CaO), and magnesia.

However, in the case of quartz and cristobalite in said first mold forming materials, when titanium is used as a casting material, the mold tends to be wetted by and react with the molten titanium. Thus, where said first mold forming materials are used to perform casting using titanium as a casting material, there has been a problem that the resulting castings tend to have casting surface defects and gas-caused defects.

Further, if said second mold forming materials are used instead of said first mold forming materials, said drawbacks become less frequent, but since said second mold forming materials cannot compensate for shrinkage which takes place during solidification of titanium, there is a problem that the resulting casting is smaller in size than required.

Thus, recently, a superior method has been proposed. According to this method, zirconium powder is added to mold forming materials to utilize the fact that zirconium oxidizes and expands during heating and firing; thus, shrinkage during solidification is compensated for. However, since zirconium is very difficult to refine, it is expensive; thus, there are problems concerning its practical use.

A study is also being made of the addition of other metal powders, but there are such problems as formation of bubbles due to reaction between metal and water, cracks occurring during heating and firing, and casting surface defects. Thus, such metal powders have not been put into practical use.

SUMMARY OF THE INVENTION

An object of the present invention is to provide a mold forming material which decreases such casting defects as casting surface defects and gas-caused defects and compensates for solidification shrinkage of titanium and the like to ensure dimensional accuracy of castings and which is inexpensive and highly practically useful.

DESCRIPTION OF THE PREFERRED EMBODIMENTS

A mold forming material according to this invention, which is used, for example, in dental casting, contains spodumene serving as an expansive agent during heating and firing.

Spodumene is a lithium mineral whose theoretical composition formula is $Li_2O\ Al_2O_3\ 4SiO_2$, containing such impurities as quartz and lepidolite; the ordinary class contains about 5–8% $Li_2O$.

When heated, spodumene transforms from $\alpha$ type to $\beta$ type at temperatures of 900°–1,100° C., and irreversibly expands.

Therefore, if a mold forming material containing spodumene and also containing, as fire resistant materials, one or more members selected from the group consisting of alumina, zircon, zirconia, calcium oxide, magnesia, quartz, and cristobalite is used, desired mold expansion can be obtained, making it possible to compensate for solidification shrinkage of titanium and the like.

Furthermore, since spodumene is an oxide, it is stable even if it is in powder form, and it is safe and easy to handle, free from such drawbacks as reaction with water and ignitability as found in many metal powders. Further since it is inexpensive, it can be put to practical use.

The amount of spodumene in said mold forming material is suitably 1–20% by weight. If the amount is less than 1% by weight, spodumene can no longer contribute to expansion of the mold. On the other hand, if the amount exceeds 20% by weight, the resulting castings have surface defects.

In addition, the particle size of spodumene is preferably 100 $\mu$m or less.

Further, binders for said mold forming material are preferably phosphates and basic metal oxides. It is preferable that the phosphate be ammonium primary phosphate ($(NH_4)H_2PO_4$) and that the basic metal oxide be magnesia.

On the other hand, in order to improve casting surfaces, one or more members selected from the class consisting of alumina cement, magnesia cement, zirconia cement, and silica cement may be used as binders. In this case, however, curing is retarded.

An example of the chemical composition of spodumene is shown in Table 1.

TABLE 1

| | Chemical Composition of Spodumene (in percentage by weight) | | |
|---|---|---|---|
| | Theoretical value | Ordinary class (example) | High purity class (example) |
| $SiO_2$ | 64.5 | 73.0 | 64.5 |
| $Al_2O_3$ | 27.4 | 18.7 | 26.0 |
| $LiO_2$ | 8.4 | 6.9 | 7.5 |
| $Fe_2O_3$ | — | 0.2 | 0.1 |
| $Na_2O$ | — | 0.4 | 0.1 |
| $K_2O$ | — | 0.2 | 0.1 |

When it is desired to perform casting by using a mold forming material which contains spodumene, the mold forming material is added to water or colloidal silica and the mixture is kneaded so that there is no air bubble formed therein, and the mixture is then poured into a ring having a wax pattern set therein in advance. Then, the mold forming material cures in about 10–60 minutes. It is removed from the ring and put in an electric furnace, where it is heated to not less than 900° C., preferably to 1,100° C. and held for about 30 minutes to effect the burning of the wax and the firing of the mold forming material. At this time, the mold forming material expands according to the amount of the spodumene.

Thereafter, it is cooled to a predetermined mold temperature for casting, preferably to ordinary temperature, whereupon molten pure titanium or titanium alloy is poured.

The pouring is effected in an argon gas atmosphere by using an arc casting machine.

After the molten metal has been poured, it solidifies and cools while slightly shrinking. Thereafter, this casting is removed from the mold and subjected to such treatments as blasting and grinding; thus, a high precision casting having the same shape and size as the wax pattern is obtained.

It is important from the standpoint of securing high accuracy of castings that at the time of pouring, the mold have expanded according to the solidification shrinkage of molten titanium.

Experiments using titanium as a casting material are shown below.

EXPERIMENT NOS. 1-7

Table 2 (½), (2/2) below shows Experiment Nos. 1-7. The term "phosphate" in the table means ammonium primary phosphate and the term "kneading liquid" means a kind of liquid used for kneading the mold forming material. Further, the mark O means good, the mark Δ means rather good, and the mark—means bad (this applies also to other experiments).

TABLE 2

| Experiment No. | | 1 | 2 | 3 | 4 | 5 | 6 | 7 |
|---|---|---|---|---|---|---|---|---|
| Content/ percentage by weight | Quartz | 45 | 45 | 45 | 45 | 44 | 44 | 43 |
| | Cristobalite | 35 | 35 | 35 | 35 | 35 | 34 | 32 |
| | Phosphate | 10 | 10 | 10 | 10 | 10 | 10 | 10 |
| | Magnesia | 10 | 10 | 10 | 10 | 10 | 10 | 10 |
| | Spodumene | 0 | 0 | 0 | 0 | 1 | 2 | 5 |
| Kneading liquid | | Water | Water | Water | Colloidal silica | Water | Water | Water |
| Mold firing temperature °C. | | 800 | 800 | 1100 | 1100 | 1100 | 1100 | 1100 |
| Mold temperature at the time of pouring, °C. | | 700 | 30 | 30 | 30 | 30 | 30 | 30 |
| Casting results | Casting surface | — | Δ | Δ | — | Δ | Δ | Δ |
| | Gas-caused defect | — | — | Δ | — | Δ | Δ | Δ |
| | Dimensional accuracy | ○ | — | — | Δ | Δ | ○ | Δ |
| | Overall assessment | — | — | — | — | Δ | Δ | Δ |

In Experiment Nos. 1-4 in Table 2, a conventional mold forming material was used. That is, in these experiments, a phosphate-bound investment material consisting of quartz, cristobalite, phosphate and magnesia was used. In these experiments, when the mold forming material was heated to about 800° C. and fired, the cristobalite and quarts transformed from $\alpha$ type to $\beta$ type, at about 250° C. and about 570° C., respectively, and reversibly expanded. Therefore, if pouring is effected at a mold temperature of not less than 700° C., the solidification shrinkage is compensated for by the sufficient expansion coefficient. However, when titanium was poured, casting surface defects and gas-caused defects were produced.

As in Experiment Nos. 2 and 3, when the mold was cooled to ordinary temperature before pouring, casting surface defects and gas-caused defects were decreased. However, since the transformation expansion of silica and cristobalite is reversible, with cooling they shrunk substantially to their before-firing size. And in the case of pouring at ordinary temperature, the solidification shrinkage was hardly compensated for and the casting obtained was smaller in size than the wax pattern; that is, the dimensional accuracy was poor.

On the other hand, when a phosphate-bound investment material was kneaded using colloidal silica rather than water, as in Experiment No. 4, the mold expanded as it cured. This mechanism for curing expansion, though not fully investigated, is commonly used. If this method is used, expansion can be secured to a certain extent and improved dimensional accuracy is attained even if the mold is at ordinary temperature But when titanium was poured, casting surface defects and gas-caused defects were produced.

In Experiment Nos. 5-7, spodumene was added to a mold forming material And when this mold forming material was heated to 1,100° C. and fired, it reversibly expanded at 900°-1,100° C., so that even when it was cooled to ordinary temperature, compensation for solidification shrinkage of titanium was possible and improved dimensional accuracy was attained.

EXPERIMENT NOS. 8-12

Quartz and cristobalite are $SiO_2$ (silica) and when they are used as mold forming materials, the molds are easily wetted by and react with molten titanium. For this reason, castings tend to be formed with casting surface defects and gas-caused defects In contrast thereto, alumina, zircon, zirconia, calcium oxide and magnesia are thermodynamically relatively stable oxides.

Accordingly, zircon and alumina were used as fire resistant materials to perform Experiment Nos. 8-12. The results are shown in Table 3 (½), (2/2)

TABLE 3

| Experiment No. | | 8 | 9 | 10 | 11 | 12 |
|---|---|---|---|---|---|---|
| Content/ percentage by weight | Alumina | 44 | 44 | 43 | 41 | 39 |
| | Zircon | 43 | 43 | 42 | 41 | 38 |
| | Phosphate | 7 | 7 | 7 | 7 | 7 |
| | Magnesia | 6 | 6 | 6 | 6 | 6 |
| | Spodumene | 0 | 0 | 2 | 5 | 10 |
| Kneading liquid | | Water | Colloidal silica | Water | Water | Water |
| Mold firing temperature °C. | | 1100 | 1100 | 1100 | 1100 | 1100 |

TABLE 3-continued

| Experiment No. | | 8 | 9 | 10 | 11 | 12 |
|---|---|---|---|---|---|---|
| Mold temperature at the time of pouring, °C. | | 30 | 30 | 30 | 30 | 30 |
| Casting results | Casting surface | ○ | Δ | ○ | ○ | ○ |
| | Gas-caused defect | ○ | Δ | ○ | ○ | ○ |
| | Dimensional accuracy | — | — | Δ | ○ | Δ |
| | Overall assessment | — | — | Δ | ○ | Δ |

In Experiments 8 and 9 in Table 3, a conventional materials was used as a mold forming material.

Since zircon and alumina are thermodynamically relatively stable oxides, if they are used as fire resistant materials as in Experiment Nos. 8 and 9, castings having neat casting surfaces and free from casting defects are obtained. However, the molds obtained after firing and cooling, unlike those formed mainly of silica, considerably shrink before firing; thus, the resulting castings were smaller than the wax pattern; that is, the dimensional accuracy was poor.

In Experiment Nos. 10–12, spodumene was added to mold forming materials. The results were better owing to the function of spodumene.

EXPERIMENT NOS. 13–17

Table 4 (½), (2/2) shows Experiment Nos. 13–17. In these experiments, zirconia cement was used as a binder.

TABLE 4

| Experiment No. | | 13 | 14 | 15 | 16 | 17 |
|---|---|---|---|---|---|---|
| Content/ percentage by weight | Magnesia | 95 | 95 | 90 | 85 | 75 |
| | Zirconia cement | 5 | 5 | 5 | 5 | 5 |
| | Spodumene | 0 | 0 | 5 | 10 | 20 |
| Kneading liquid | | Water | Water | Water | Water | Water |
| Mold firing temperature °C. | | 1100 | 1100 | 1100 | 1100 | 1100 |
| Mold temperature at the time of pouring, °C. | | 30 | 150 | 150 | 150 | 150 |
| Casting results | Casting surface | Δ | ○ | ○ | ○ | Δ |
| | Gas-caused defect | Δ | ○ | ○ | ○ | Δ |
| | Dimensional accuracy | — | — | Δ | ○ | Δ |
| | Overall assessment | — | — | Δ | ○ | Δ |

In Experiment Nos. 13 and 14 in TAble 4, the mold forming material is conventional. In Experiment No. 13, since the mold was cooled to ordinary temperature after firing, it absorbed moisture and carbon dioxide gas in air, forming casting surface defects and gas-caused defects. In contrast, in Experiment No. 14, since the cooling subsequent to firing was limited to not less than 150° C., there were no casting surface defects. However, in each of Experiment Nos. 13 and 14, the dimensional accuracy was poor.

In Experiment Nos. 15–17. since spodumene was added to the mold forming material, good results were obtained owing to its function.

In addition, the casting metal is not limited to titanium type but Co-Cr alloys, Ni-Cr alloys, gold alloys, silver alloys and the like may be used. Further, besides metals, ceramic materials and glass may be used for casting.

What is claimed is:

1. A mold forming material comprising, as a fire resistant material, at least one component selected from the group consisting of alumina, zircon, zirconia, calcium oxide, quartz and cristobalite; as a binder, a mixture of ammonium primary phosphate and magnesium oxide; and 1–20% by weight, based on the weight of the mold forming material, of α-spodumene.

2. A mold forming material comprising, as a fire resistant material, at least one component selected from the group consisting of alumina, zircon, zirconia, calcium oxide, magnesia, quartz and cristobalite; as a binder, at least one component selected from the group consisting of alumina cement, magnesia cement, zirconia cement and silica cement; and 1–20% by weight, based on the weight of the mold forming material, of α-spodumene.

* * * * *